US005615750A

United States Patent [19]

Phillips

[11] Patent Number: 5,615,750

[45] Date of Patent: Apr. 1, 1997

[54] CLIMBING HARNESS HAVING ADJUSTABLE LEG LOOPS AND RISE

[76] Inventor: Douglas D. Phillips, H.C.R. 2193, Camp Sherman, Oreg. 97730

[21] Appl. No.: 415,487

[22] Filed: Apr. 3, 1995

[51] Int. Cl.[6] ..... A62B 1/16

[52] U.S. Cl. ..... 182/6; 182/7

[58] Field of Search ..... 182/3, 6, 7; 244/151 R

[56] References Cited

U.S. PATENT DOCUMENTS

| | | | |
|---|---|---|---|
| 2,424,134 | 1/1969 | Rozenblum | 182/3 |
| 5,145,027 | 9/1992 | Petzl | 182/6 |

OTHER PUBLICATIONS

PETZL catalog, 1993, pp. 26–41, printed in France.

1995 Rescue Systems, Inc. catalog, pp. 47–56.

Fjellsport catalog, David Durkan, 1993, 3 pages (no translation available).

Metolius Mountain Products, Inc. Brochure: Climbing Harness Leg Loops; Jan. 1994.

Metolius Mountain Products, Inc. Brochure: Climbing Harness: Metolius S–1 Jan. 1994.

Metolius Mountain Products, Inc. Brochure: Climbing Harness: Metolius Smart Jan. 1994.

Metolius Mountain Products, Inc. Brochure: Climbing Harness: Metolius Big Buckle; Jan. 1994.

*Primary Examiner*—Alvin C. Chin-Shue

*Attorney, Agent, or Firm*—Robert D. Varitz

[57] ABSTRACT

A climbing harness includes a waistband and a pair of leg loops. The leg loops have an adjustable girth for fitting about the user's thigh. The leg loops are joined to the waist band. An adjustment mechanism is provided which allows the user to adjust the rise of the leg loops relative to the waist band and also to adjust the girth of the leg loop.

10 Claims, 2 Drawing Sheets

CLIMBING HARNESS HAVING ADJUSTABLE LEG LOOPS AND RISE

BACKGROUND OF THE INVENTION

The invention relates to climbing harnesses, and specifically to a climbing harness which allows the user to adjust both the girth of leg loops of the harness and also to adjust the rise between the leg loops and a waist band with a single adjustment mechanism.

Climbing harnesses are used for a variety of recreation and commercial purposes. Recreational uses include mountain climbing and exploration of caves, while commercial purposes may include high-rise window washing and emergency service rescues. A great variety of climbing harnesses exist. Some harnesses, particularly those used for commercial purposes, may be full-body harnesses, which include shoulder and chest straps as well as a waist band and leg loops. Other harnesses may be have only a simple waist band such as might be worn as a safety harness by a person participating in climbing wall activities.

Climbing harnesses which are used for recreation may be used in a variety of environments. Alpinists may require harnesses which may be donned and removed over heavy boots and/or skies. Climbers who explore caves may require harnesses which are flexible and resistant to abrasion, and which are also comfortable when partially or fully submerged in water.

The primary purpose of any climbing harness, however, whether for recreation or commercial use, is the prevent gravity from having an adverse effect on the climber. To this end, a climbing harness must be both functional and comfortable, and must be correctly fit to the user.

Known harnesses provide for a number of adjustments to allow the user to fit the harness to the user's body. While a number of harnesses are known which have adjustable leg loops, wherein the girth of the leg loop may be adjusted about the user's thigh, known harnesses do not allow for the adjustment of the rise, which, as used herein in the case of a climbing harness, is the distance between the waistband and the leg loops. The previously known solution to this problem has been to provide leg loops which are detachable from a waist band, and for manufacturers to provide the leg loop assembly in a variety of sizes. However, the sizes generally provide a large leg loop with a long rise. This still does not adequately solve the problem in the case where a climber is short waisted and has large legs.

SUMMARY OF THE INVENTION

The climbing harness of the invention includes a waistband. A pair of leg loop are provided, which leg loops have an adjustable girth for fitting about the user's thigh. The leg loops are joined to the waistband. An adjustment mechanism is provided which allows the user to adjust the rise of the leg loop and also to adjust the girth of the leg loop.

An object of the invention is to provide a climbing harness which safely will support a user during climbing activities, and which is fully adjustable to the user's body.

Another object of the invention is to provide a climbing harness which allows a user to adjust the rise of leg loops relative to a waistband of the harness.

A further object of the invention is to provide a climbing harness having adjustable girth leg loops.

Still another object of the invention is to provide a climbing harness which has detachable leg loops secured to a waist band.

These and other objects of the invention will become more fully apparent as the description which follows is read in conjunction with the drawings.

BEST MODE OF PRACTICING THE INVENTION

Figure 1:
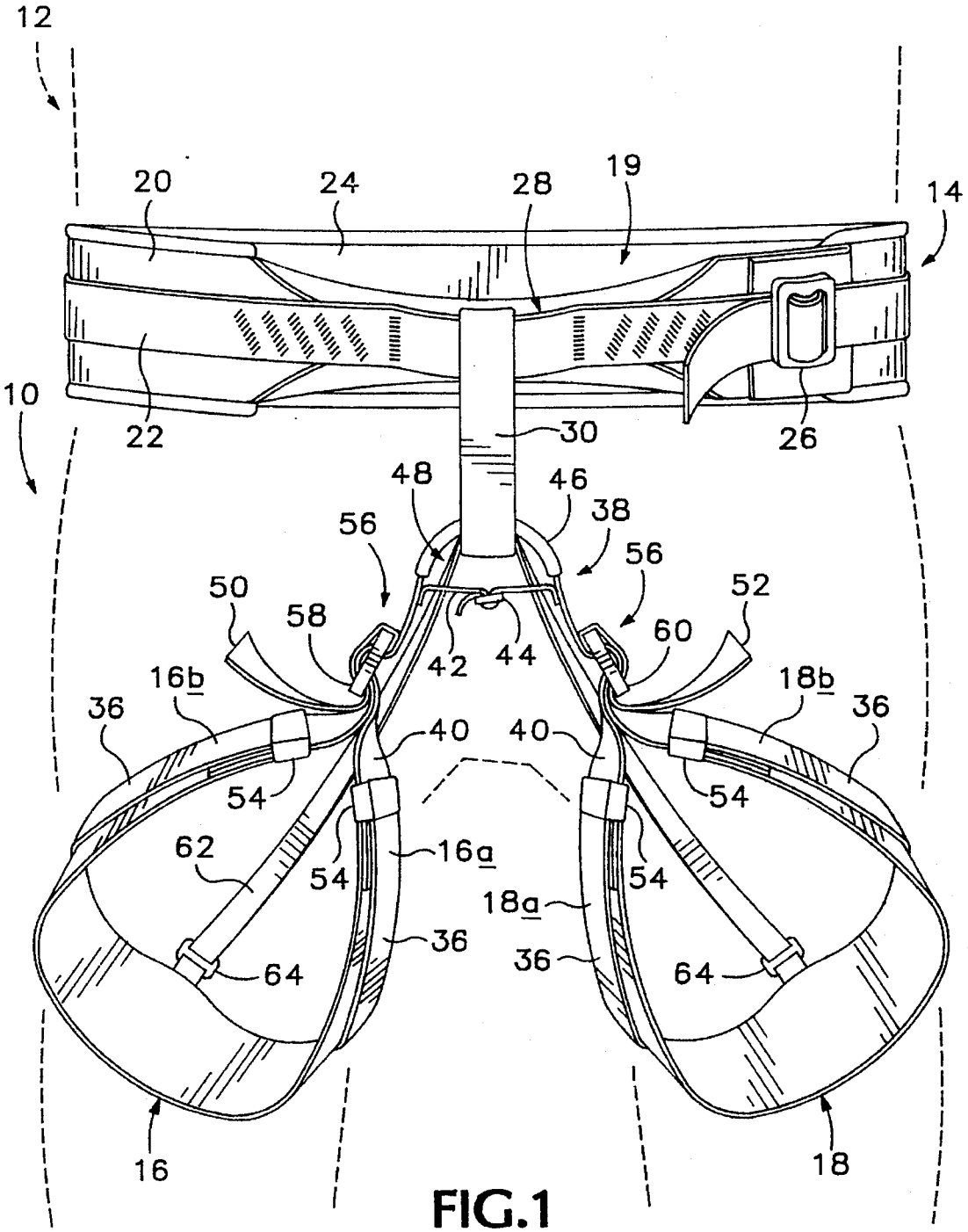
FIG. 1 elevation of the climbing harness constructed according to the invention.
Figure 2:
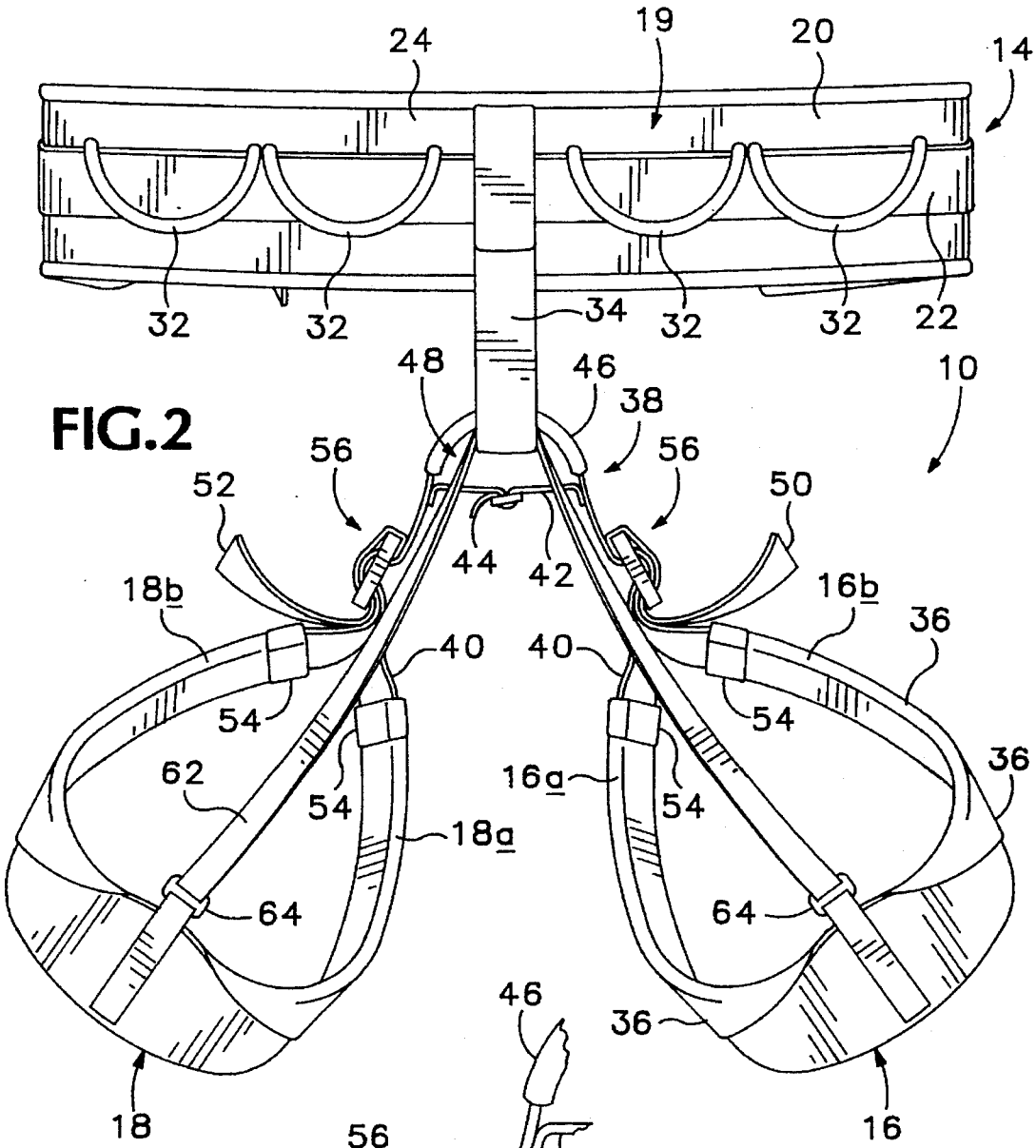
FIG. 2 is rear elevation of the climbing harness of FIG. 1.

Turning now to the drawings, and initially to FIGS. 1 and 2, a climbing harness constructed according to a preferred embodiment of the invention is depicted generally at 10. In FIG. 1, climbing harness 10 is depicted on an outline of a human form, depicted in phantom at 12. Harness 10 includes a waistband 14 and a pair of leg loops, depicted at 16 and 18.

Waistband 14, also known as a "swami", includes an adjustable-girth closing strap 19. A first web 20 extends around the user's waist. A second web 22, is fixed to first web 20, as by sewing, and also extends around the user's waist. A padding member 24 is provided to enhance the safety and comfort of the climbing harness. Second web 22 serves to secure waistband 14 about the wearer's waist by means of a buckle 26 which is fixed to one end of second web 22, and through which the other end of second web 22 is trained. It should be appreciated by those of skill in the art that the fastening of the other end of second web 22 through buckle 26 must be by a double-pass loop to insure that the free end of the second web does not separate from buckle 26 at a critical instant. First web 20 and second web 22 comprise what is referred to herein as adjustable-girth closing strap, 19.

In the preferred embodiment, Closing strap 19 has a first tie-in point, depicted generally at 28, located at the front of waistband 14 between first web 20 and second web 22. A belay loop 30 is fixed through first tie-in point 28. To complete the description of waistband 14, and now referring to FIG. 2, gear loops 32 are provided on waistband 14 and are intended to provide storage locations for implements which a climber may require. It should be understood by those of skill in the art that gear loops 32 are non-structural, and are not intended to support any significant weight. A haul loop 34 is fixed about closing strap 19 at the backside of waistband 14, and provides another attachment point for the climber, although the haul loop is not intended to provide the structural integrity as the tie-in point.

Referring again to FIGS. 1 and 2, leg loops 16 and 18 each include a first free end, **16*a*, 18*a*, respectively, and a second, or other, free end, 16*b*, 18*b*, respectively. In the preferred embodiment, each leg loop is formed of a length of webbing which is tapered by means of a fold, as depicted at 36**, on each end of the leg loop to strengthen the leg loop and to provide a more comfortable fit for the user.

In the preferred embodiment, the leg loops are joined together by a centerpiece, 38, which includes a first strap 40, which is operable to join the first free ends, **16*a*, 18*a*, of leg loops 16 and 18 together. Centerpiece 38 extends through belay loop 39 and is secured to the belay loop by means of a retaining loop 42. In the preferred embodiment, retaining loop 42 includes a buckle 44 which allows the leg loops and centerpiece to be detached from the waistband. This allows interchangability of leg loops and waistbands in order to better fit the user. Centerpiece 38 includes a padded portion 46 which makes actual contact with the fabric of belay loop 30. Centerpiece 38 provides a second tie-in point depicted generally at 48** so that a user, when tying onto the harness will extend a rope through both first and second tie-in points to provide maximum safety in the event the rope is necessary to restrain the user's fall. In the event that the user is belaying or rappelling, a carabineer may be tied into the belay loop to provide the belaying activity, or to support the user during a rappel.

A second strap, shown at 50, 52, is attached to the other end of leg loops 16, 18, respectively. As may be seen in FIG. 1, first and second straps are enclosed in fold 36 of the leg loops and are secured thereto as by stitching. The ends of the leg loops are finished with a fabric web, as shown at 54.

Figure 3:
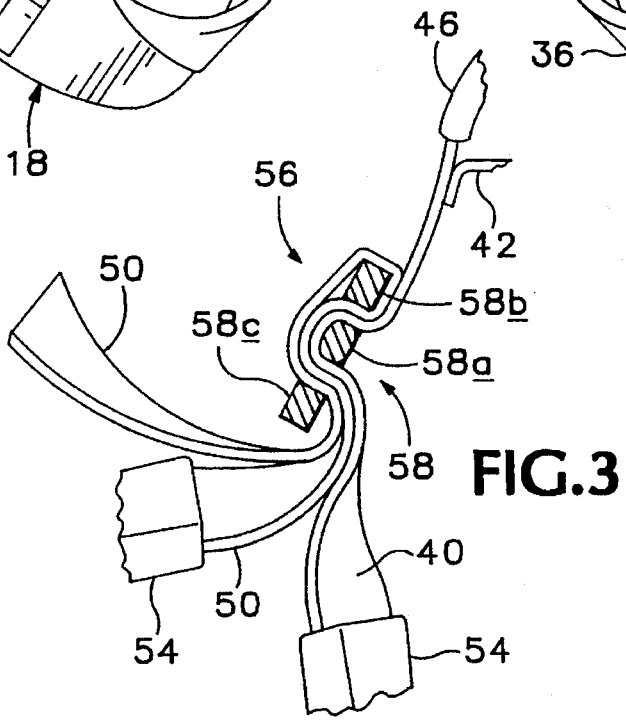
FIG. 3 is an enlarged, partially cut-away, front view of an adjustment mechanism of the invention.

Referring now to FIG. 3, an adjustment mechanism, which is operable to adjust both the girth of the leg loops and the rise between the leg loops and the waist band, is depicted generally at 56. Adjustment mechanism 56 includes buckles 58, 60, which are slidably received on first strap 40. Buckles 58, 60 are of the double-pass type, and include a center portion 58*a* and two side portions 58*b*, 58*c*. As may be seen in FIGS. 1 and 3, as buckles 58, 60 are moved along first strap 40, the effective distance between waistband 14 and the leg loops may be adjusted. The length of second straps 50, 52 between the leg loops and buckles 58, 60, respectively, may be changed, thereby changing the girth of leg loops 16 and 18.

To explain the operation of the adjustment mechanism, the effective attachment point for a leg loop is at a buckle. The girth of a leg loop may be changed and the effective attachment point may also be shifted. As a buckle, and now referring to buckle 58 in FIG. 3, is moved towards belay loop 34, the effective attachment point is located closer to waist band 14, and the rise is shortened. The rise is lengthened by moving a buckle away from the belay loop and waist band. The leg loop girth is then adjusted with strap 50.

The combination of sliding buckles 58, 60 and adjusting the girth of the leg loops provides a single-point adjustment for both the rise and leg loop girth, which makes the harness fully adjustable to fit users regardless of their thigh size or the distance between their waist and thighs. Straps 50, 52, of course, must be double passed through buckles 58, 60 for maximum safety.

To complete the description of the leg loops, an elastic strap 62 extends from leg loop 16 to leg loop 18 and is passed through haul loop 34. Strap 62, in the preferred embodiment, is fixed to one of the leg loops and is detachable from the other leg loop, again to permit interchangability of the leg loops vis-a-vis the waist band. The length of elastic back-strap 62 may be adjusted by means of buckles 64, which are carded on the back strap.

An alternate embodiment of the climbing harness may have the leg loops secured directly to the waist band. In this embodiment, a one end of the leg loop is attached to a first leg loop strap, which is secured to the waist band. The other end of the leg loop is attached to a second leg loop strap. The adjustment mechanism includes a buckle located along the length of the first leg loop strap, which receives the second leg loop strap therein. As in the preferred embodiment, the length of rise is changed by adjusting the location of the buckle along the first leg loop strap, while the girth of the leg loop is changed by adjusting the second leg loop strap in the buckle. The first leg loop strap may be attached to a single leg loop and to the waist band, or the first leg loop strap may be attached to both leg loops and then to the waist band, and may form a tie-in point.

Although a preferred embodiment of the invention has been described herein, it should be appreciated that further modifications may be made thereto without departing from the scope of the invention as defined in the appended claims.

I claim:

1. A climbing harness comprising:

a waist band having an adjustable-girth closing strap;

a tie-in point located on said closing strap;

a pair of leg loops, each leg loop being constructed and arranged to encompass the leg of a user about the user's thigh;

a leg loop strap for attaching each of said leg loops to said waist band; and an adjustment mechanism associated with each leg loop for simultaneously adjusting the girth of each of said leg loops to a fixed circumference and adjusting the length of said leg loop strap to a fixed length, thereby providing an adjustment in the length of rise between said leg loops and said waist band.

2. The climbing harness of claim 1 which further includes a belay loop affixed through said tie-in point and wherein said leg loop straps form a centerpiece joining said leg loops together, said center piece including a second tie-in point, and wherein said centerpiece extends through said belay loop.

3. The climbing harness of claim 2 wherein each leg loop is constructed and arranged with a pair of spaced-apart free ends, and wherein said center-piece includes a first leg loop strap which is attached, at each end thereof to a free end of a leg loop, and which further includes a second leg loop strap attached to the other free end of each leg loop, wherein said adjustment mechanism includes a pair of buckles slidably received on said first leg loop strap, each of which are constructed and arranged to receive said second leg loop strap therein; wherein movement of a buckle along said first leg loop strap is operable to adjust and fix the rise of the associated leg loop and movement of said second leg loop strap relative to a buckle is operable to adjust and fix the girth of the associated leg loop.

4. The climbing harness of claim 2 wherein said centerpiece includes a retaining loop for retaining said centerpiece in a lateral position relative to said belay loop.

5. The climbing harness of claim 1 wherein each of said leg loops includes a detachable elastomeric back-strap which extends from a point intermediate the ends of said leg loop to said waist band.

6. The climbing harness of claim 5 wherein each of said leg loops includes a detachable elastomeric back-strap which extends from a point intermediate the ends of said leg loop to said waist band.

7. A climbing harness comprising:

a waist band having an adjustable-girth closing strap;

a first tie-in point located on said closing strap;

a belay loop affixed through said first tie-in point;

a pair of leg loops, each leg loop being constructed and arranged to encompass the leg of a user about the user's thigh, and having spaced-apart free ends, one end having a first strap extending therefrom and the other end having a second strap extending therefrom;

a center-piece, including said first straps, joining said leg loops together, said center piece including a second tie-in point; wherein said center piece extends through said belay loop; and an adjustment mechanism for adjusting and fixing, independently, the girth of each of said leg loops to a fixed circumference and adjusting and fixing the length of said center piece, thereby providing an adjustment in the length of rise between said leg loops and said waist band, wherein said adjustment mechanism includes a buckle associated with each leg loop, slidably received on said first strap, wherein said second strap is double passed through said buckle, and wherein movement of said buckle and said second strap along said first strap is operable to adjust and fix the rise of the associated leg loop and movement of said second strap relative to said buckle and said first strap is operable to adjust and fix the girth of the associated leg loop.

8. The climbing harness of claim 6 wherein said center-piece includes a retaining loop for retaining said center-piece in a lateral position relative to said belay loop.

9. A climbing harness comprising:

a waist band having an adjustable-girth closing strap;

a first tie-in point located on said closing strap;

a belay loop affixed through said first tie-in point;

a pair of leg loops, each leg loop being constructed and arranged to encompass the leg of a user about the user's thigh, wherein each leg loop includes a pair of space-apart free ends;

a center-piece, having a first strap therein which joined to a free end of said leg loop thereby joining said leg loops together, said center piece including a second tie-in point; wherein said center piece extends through said belay loop and includes a retaining loop for retaining said center-piece in a lateral position relative to said belay loop;

a second strap attached to the other free end of each leg loop; and an adjustment mechanism including a pair of buckles slidably received on said first strap, each of which are constructed and arranged to receive said second strap therein; wherein movement of a buckle along said first strap is operable to change and fix the effective attachment point of a leg loop, thereby to adjust and fix the rise of the associated leg loop and movement of said second strap relative to a buckle is operable to adjust and fix the girth of the associated leg loop.

10. The climbing harness of claim 9 wherein each of said leg loops includes a detachable elastomeric back-strap which extends from a point intermediate the ends of said leg loop to said waist band.

* * * * *